US006450570B1

(12) United States Patent
Hoekstra et al.

(10) Patent No.: US 6,450,570 B1
(45) Date of Patent: Sep. 17, 2002

(54) WHEELCHAIR TABLE WITH ERGONOMIC AID

(75) Inventors: Robert L. Hoekstra, Oviedo, FL (US); Michael Mullens, Maitland, FL (US); Jose Gonzalez, Orlando, FL (US); Rashendra A. Shah, Deland, FL (US); Prasanth Kumar Thupili, Orlando, FL (US); Jon Moen, Eugene, OR (US)

(73) Assignee: University of Central Florida, Orlando, FL (US)

( * ) Notice: Subject to any disclaimer, the term of this patent is extended or adjusted under 35 U.S.C. 154(b) by 0 days.

(21) Appl. No.: 09/708,793

(22) Filed: Nov. 8, 2000

Related U.S. Application Data

(60) Provisional application No. 60/200,814, filed on Apr. 28, 2000.

(51) Int. Cl.[7] ..... A47B 39/00

(52) U.S. Cl. ..... 297/153

(58) Field of Search ..... 297/153, 148, 297/135, 149, 173, DIG. 4, 174 R, 188.01, 188.14, 188.2, 188.21; 108/3, 6, 50.14, 157.11

(56) References Cited

U.S. PATENT DOCUMENTS

| | | | | |
|---|---|---|---|---|
| 647,527 A | | 4/1900 | Schleuning | |
| 723,148 A | | 3/1903 | Dukesmith | |
| 1,790,808 A | * | 2/1931 | Griffith | |
| 1,976,034 A | | 10/1934 | Poetsch | 45/60 |
| 3,142,511 A | | 7/1964 | Rehel | 297/149 |
| 3,278,225 A | * | 10/1966 | Stine | |
| 3,475,052 A | * | 10/1969 | Kaposi | |
| 4,054,315 A | | 10/1977 | Czarnowski | 297/153 |
| 5,228,711 A | | 7/1993 | Summers | 280/304 |
| 5,454,581 A | | 10/1995 | Ringer | 280/304.1 |
| 5,588,663 A | | 12/1996 | Rundle | 280/304.1 |
| 5,720,520 A | * | 2/1998 | Bengtson et al. | |

* cited by examiner

*Primary Examiner*—Milton Nelson, Jr.
(74) *Attorney, Agent, or Firm*—Brian S. Steinberger; Law Offices of Brian S. Steinberger, P.A.

(57) ABSTRACT

An attachable and detachable wheelchair tray with an adjustable work surface is disclosed. The adjustable work surface has two parts connected with a hinge. Part one is a horizontal stationary supporting base and part two is a movable top portion which can be tilted in an angular range of from 90 degrees to 180 degrees in relationship to the horizontal base. There is also an extendible auxiliary supporting rack attached to the movable top portion that allows the user to enlarge or reduce the work surface, thus permitting access to more items, references, publications at a time. All adjustments of the work surface are easily controlled with levers, buttons or foot pedals, called "Ergo Aids" which are located on or in close proximity to the wheelchair tray, in a place that is most convenient for the seated user. Fluid piston cylinders using compressed air, carbon dioxide or nitrogen provide the power required to move and adjust the tray with minimal force being applied to each control. Adjustments to a work surface that were previously very difficult for persons with limited manual dexterity are now easily made because the Ergo Aids require motions that are well within the ability of a seated user.

20 Claims, 6 Drawing Sheets

FIG. 6A
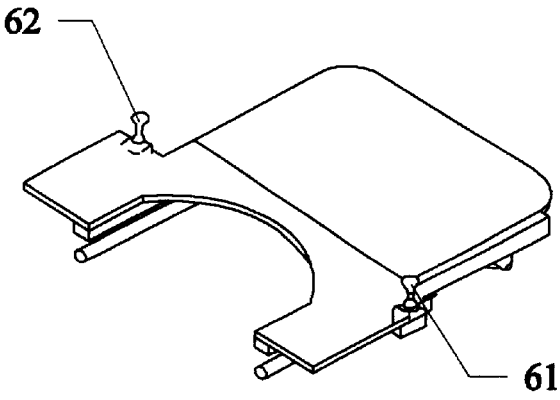
FIG. 6B
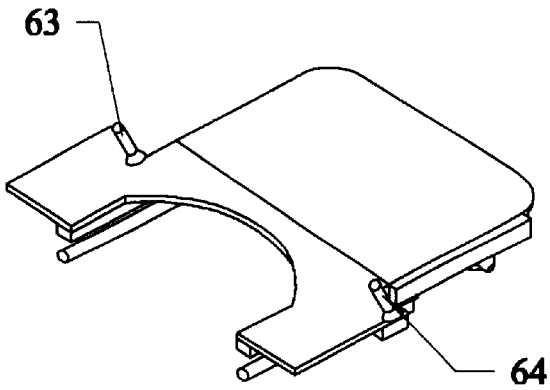
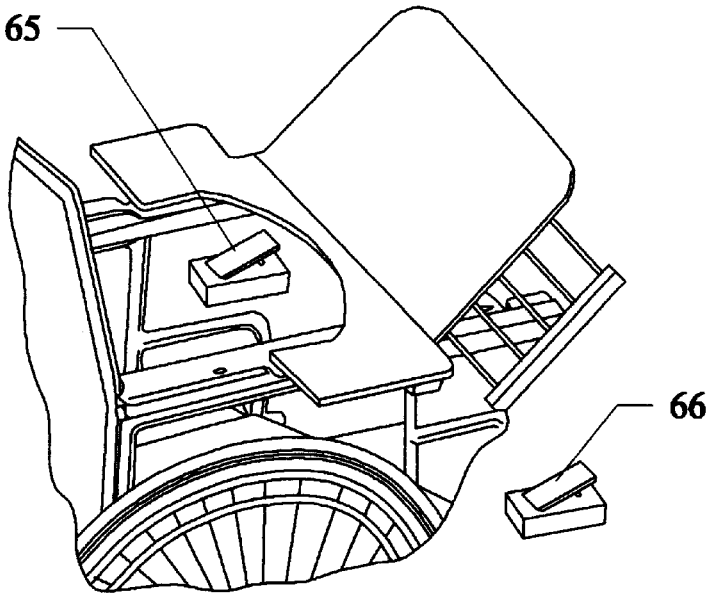
FIG. 6C

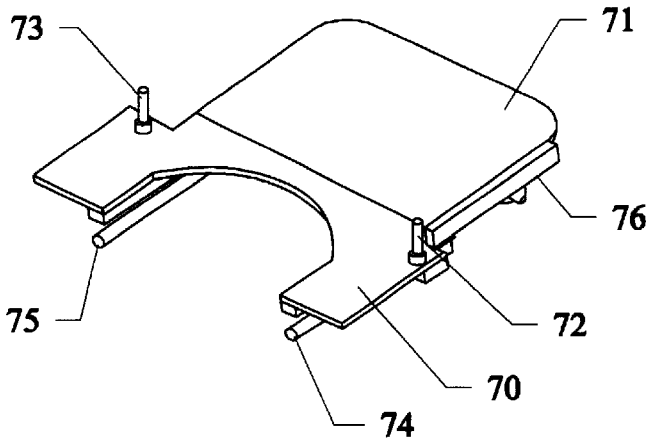
FIG. 7
FIG. 8
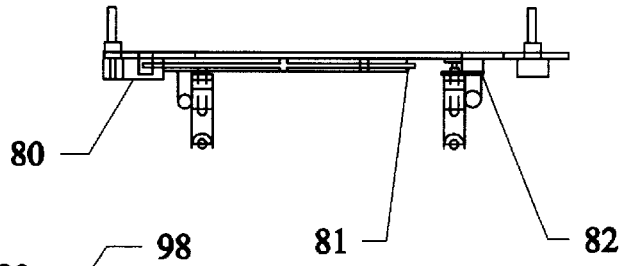
FIG. 9
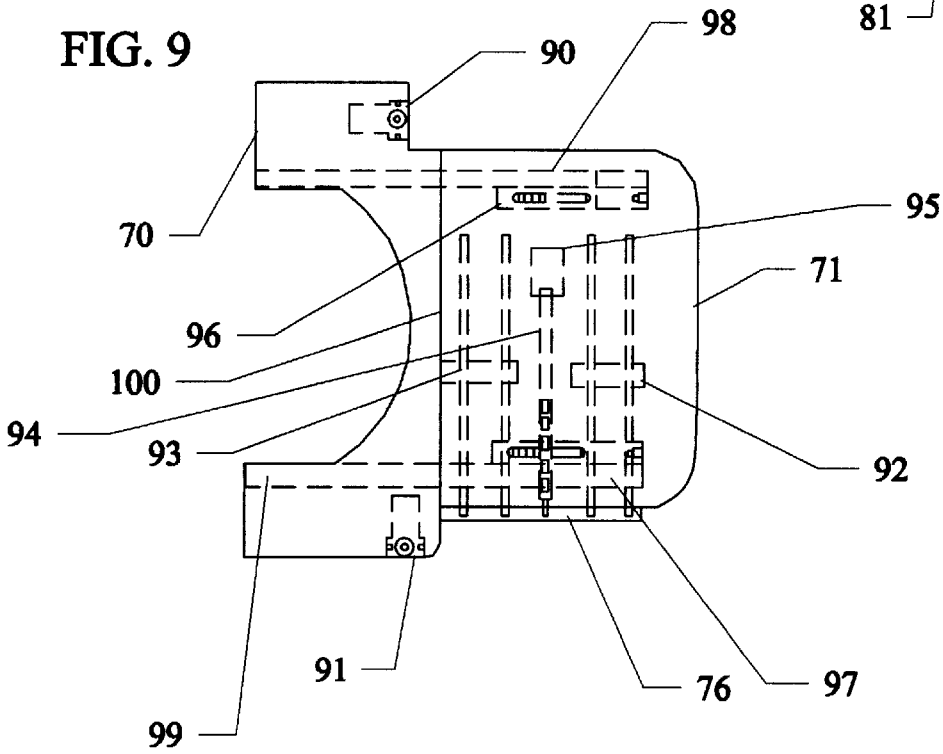

FIG. 10A
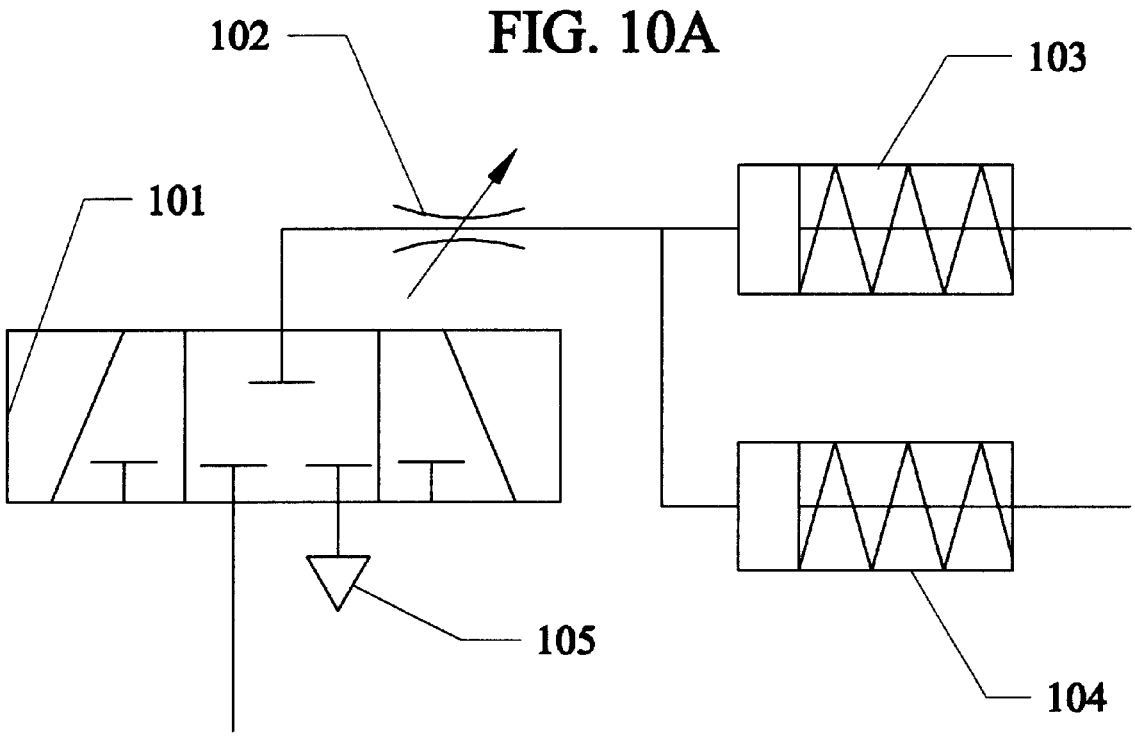
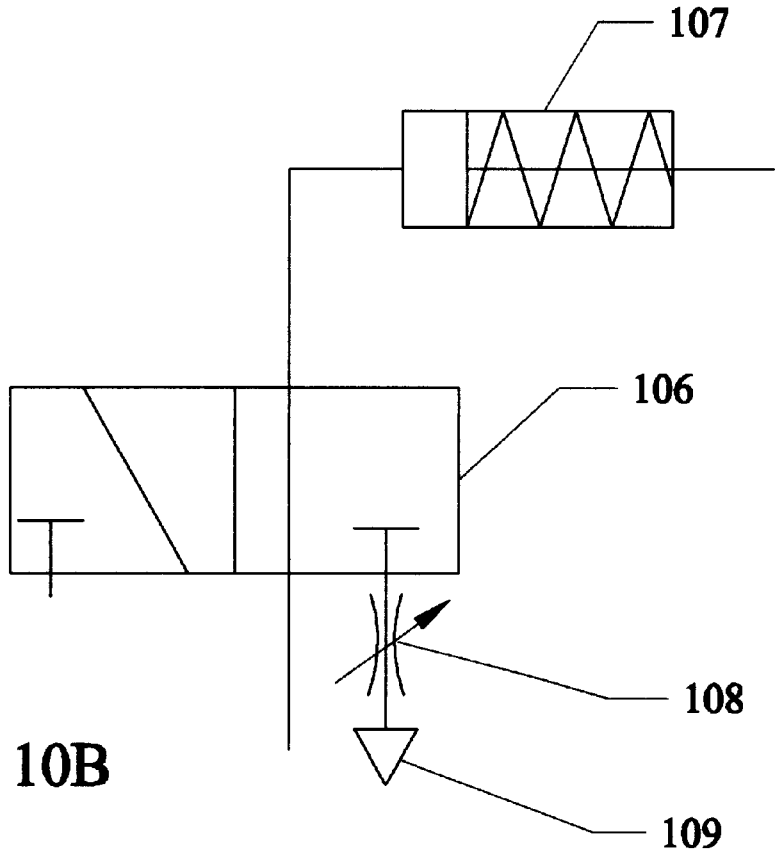
FIG. 10B

WHEELCHAIR TABLE WITH ERGONOMIC AID

This invention relates to accessory tray tables for wheelchairs, and in particular to a wheelchair tray with an adjustable work envelope that is controlled ergonomically and claims the benefit of priority to U.S. Provisional Application 60/200,814 filed Apr. 28, 2000.

BACKGROUND AND PRIOR ART

Wheelchair attachments and accessories are well known. Tray tables and work envelopes support items involved in daily activities and are needed to make life easier for a seated user. Prior art patents disclose a number of tray tables beneficial to the wheelchair confined. However, the prior art devices do not provide tray tables to address the needs of persons with severe impairment of hand motor skills. As illustrated in the prior art examples that follow, all existing table accessories require reaching, grasping, pulling or other movements that are not easy for persons with dexterity problems.

For almost a century, there have been inventions to provide an adjustable work surface for a seated user. In U.S. Pat. No. 723,148 issued to Dukesmith in 1903, a table design is disclosed with a fold-out shelf and writing surface. Significant manual dexterity is required of the user—reaching, latching, turning, rotating and the like. Similarly, U.S. Pat. No. 1,975,034 to Poetsch discusses a table with a base and four legs having a table surface that can be tilted at several angles and used as a support surface for reading, writing, sketching, playing games, sewing and other such activities. The table surface must be lifted from a concealed position and manually adjusted upward and outward from the base.

Examples of adjustable tables specifically designed for wheelchairs are disclosed in U.S. Pat. No. 3,142,511 to Rehel disclosing a table that can be attached to a wheelchair of varying widths; U.S. Pat. No. 4,054,315 to Czernowski discussing a box-like wheelchair table with leaves that open outward to provide an extended work surface; U.S. Pat. No. 5,228,711 to Summers covers a universal tray assembly that can fit either the right or left side of chair, can be tilted, rotated and is vertically adjustable; and U.S. Pat. No. 5,454,581 to Ringer discloses a desk with an adjustable height that is attached to the wheel chair frame and can be pivoted to the side of, or in front of a chair. In each instance, manipulating the tray requires bending, reaching, grasping, pulling, or clamping and bolting, which may be difficult actions that are even impossible for persons with limited manual dexterity or impaired hand motor control.

Thus, there is an unfilled need for an adjustable wheelchair table or work surface that is humanely engineered to meet the needs of people who would appreciate being able to easily adjust their work surface with movements that are within their ability.

SUMMARY OF THE INVENTION

The first objective of the present invention is to provide an accessory tray table for attachment to conventional wheelchairs.

The second objective of the present invention is to provide an accessory tray table wherein the work surface can be enlarged or reduced.

The third objective of the present invention is to provide an accessory tray table with a tilting mechanism that brings objects closer to or farther away from a seated user.

The fourth objective of the present invention is to provide an accessory tray table that functions as a back rest capable of supporting more than one publication in an open position.

The fifth objective of the present invention is to provide an accessory tray table with a horizontal stationary base that supports the arms and upper body weight of a seated user.

The sixth objective of the present invention is to provide an accessory tray table that allows a seated user to tilt, enlarge and reduce the surface area of the work envelope with the touch of a button, foot pedal or lever.

A preferred embodiment of the novel invention is a tray made of durable, lightweight, heat and fire-resistant material that contains a tilting mechanism and an enlarging/reducing mechanism in a compact manner, such that the operator feels in full control of the work surface, herein referred to as the "work envelope." It is to be noted that "work envelope" is used interchangeably herein with "movable top portion" which may or may not include an attached auxiliary supporting rack. The controls for the tray are positioned for the convenience of the seated user and can be operated like toggle switches or joy sticks giving the user the feeling of a robot like operation, thus the name for the tray disclosed herein is "ROBOTRAY."

Ergo Aid is another suitable name for this novel device which is ergonomically designed because of a concern for the characteristics of people that need to be considered in arranging things that they use, so that people and things will interact most effectively and safely.

Further objectives and advantages of this invention will be apparent from the following detailed description of a presently preferred embodiment which is illustrated in the accompanying drawings.

BRIEF DESCRIPTION OF THE FIGURES

FIG. 6A is a RoboTray with button controls .

FIG. 6B is a RoboTray with lever controls(joysticks) .

FIG. 6C is a RoboTray with foot pedal controls .

FIG. 7 is a top view of a RoboTray.

FIG. 8 is a planar view of a RoboTray from the direction of a seated user.

FIG. 9 is a cut away view of RoboTray bottom showing placement of supports, pistons, extension rods, switches and cylinders.

FIG. 10A and FIG. 10B show diagrams of compressed gas supplies with pneumatic cylinders that move the tray.

DESCRIPTION OF THE PREFERRED EMBODIMENT

Before explaining the disclosed embodiment of the present invention in detail it is to be understood that the invention is not limited in its application to the details of the particular arrangement shown since the invention is capable of other embodiments. Also, the terminology used herein is for the purpose of description and not of limitation.

Figure 1:
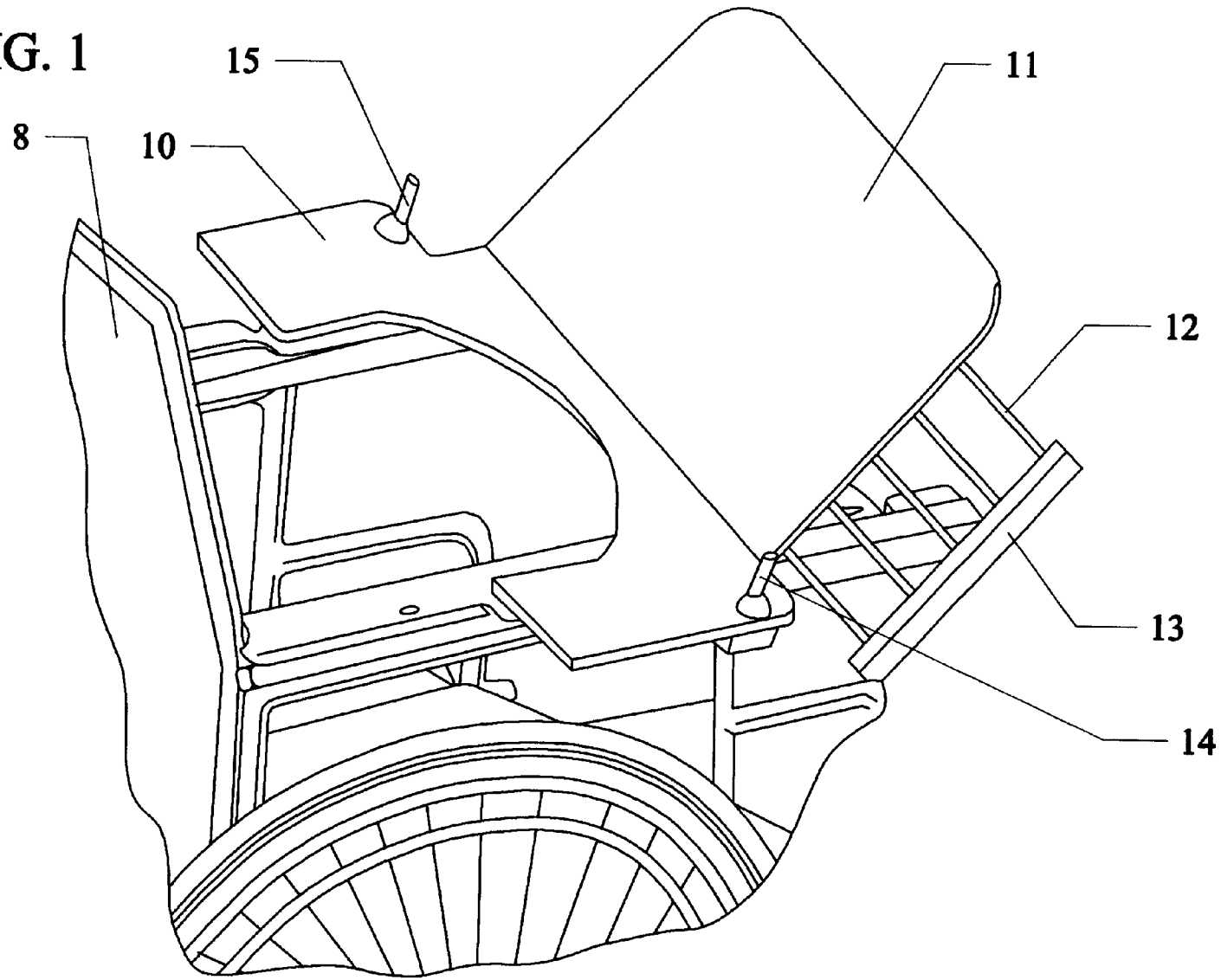
FIG. 1 is a RoboTray attached to a conventional wheelchair with auxiliary supporting rack extended to one side.

In FIG. 1, a RoboTray is shown as it would appear in an operative attachment to a wheelchair (8). The horizontal stationary supporting base (10) is connected to the movable top portion (11) via a hinge (not shown). An auxiliary supporting rack (12) having a wing-like rod configuration may be extended to enlarge the work envelope. The auxiliary rack has a raised edge (13) to close or frame the ends of the extendable rack. A first lever, sometimes called a "joystick" (14) on the right side of the horizontal stationary supporting base is used to adjust or extend the auxiliary supporting rack, thus enlarging or reducing the area of the work envelope. A second lever or joystick (15) on the left side of the supporting base is used to tilt the movable top portion (11) away from or closer to the seated user.

Figure 2:
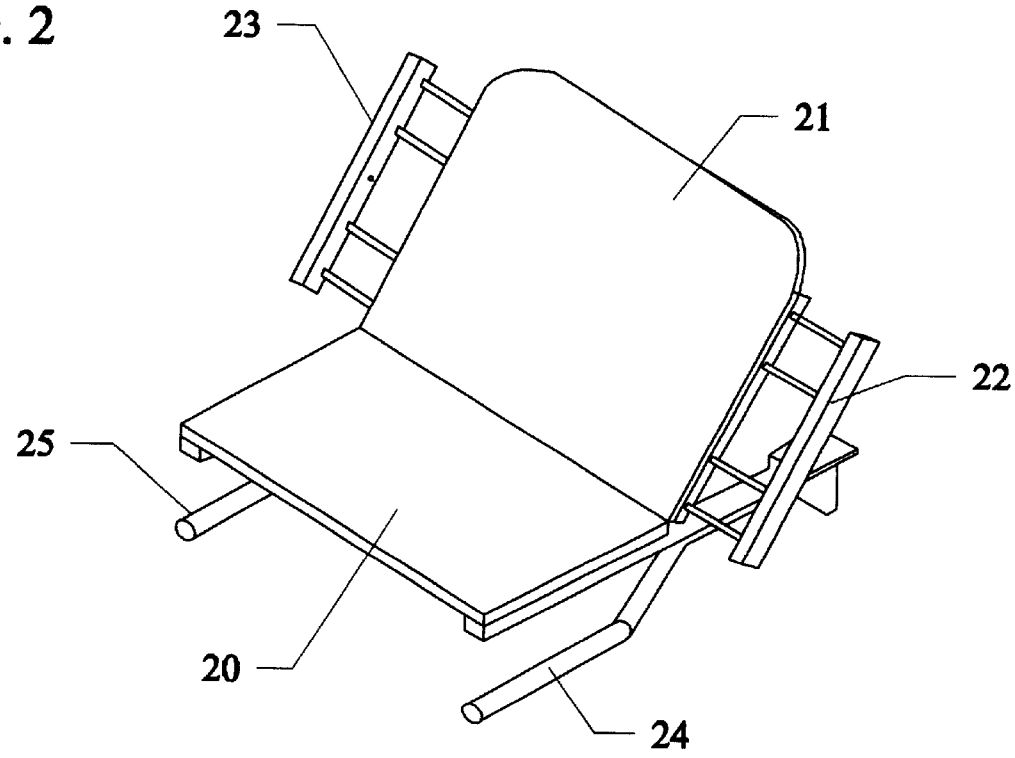
FIG. 2 is a RoboTray with auxiliary supporting rack extended to both sides.

Referring now to FIG. 2, a second embodiment of the RoboTray is shown wherein the horizontal stationary supporting base (20) has a rectangular configuration which provides a larger work surface in the horizontal plane. The movable top portion (21) has extendable racks (22, 23) that extend from both the left and right sides of a seated user. Tubular rod-like connections (24,25) are suitable for telescopingly attaching a portion of the horizontal stationary base to a wheelchair mounted with hollow tubular sections to receive the tubular rods. The rod-to-tube attachment resembles a sleeve sliding about a tube. Although this discussion is directed to wheelchairs, it is possible that this tray assembly could be attached to chairs, beds, or other seating arrangements that could accommodate the rod-to-tube or tube-to-tube connections described above.

Figure 3:
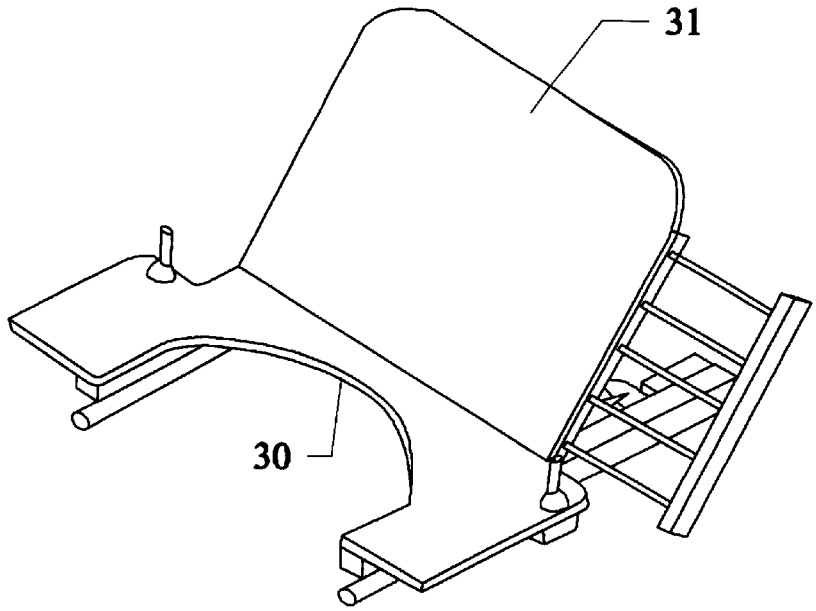
FIG. 3 is a RoboTray with cut-out edge to accommodate torso of a seated user.

In the preferred embodiment, FIG. 3 shows the cutout edge (30) to accommodate the torso of a seated user. This is a preferred arrangement for persons requiring more support for the torso and allows the user better access to the movable top portion (31). In the event books or other study materials are being supported by the movable top portion, the seated user can turn pages and consult multiple references with greater ease.

Figure 4:
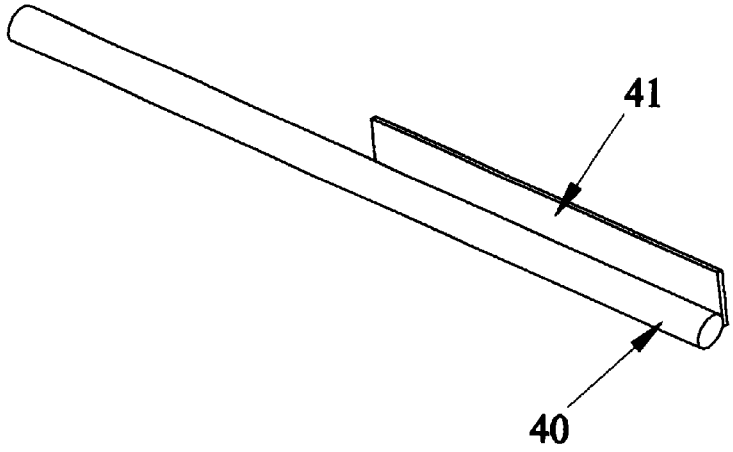
FIG. 4 is a view of the tubular steel support mounted on the wheelchair arm to telescopingly engage the tubular supports attached to the RoboTray in a sleeve-like manner.

FIG. 4 is a mounting tube to be used on a wheelchair. This tube (40) may be positioned beneath the arm rests of a chair and is preferably constructed by welding a mounting plate (41) to the tubular rod (40) that receives the tubular connection extending from the RoboTray. As previously mentioned, the tube-to-tube connection can function telescopically in the manner of a sleeve sliding about a tube. The sleeve portion is mounted on the chair. The tube-to-tube connection between the tray and the wheelchair can be secured by any known means, such as a cotter pin or latch pin so that the tray cannot be involuntarily separated from the chair.

Figure 5A:
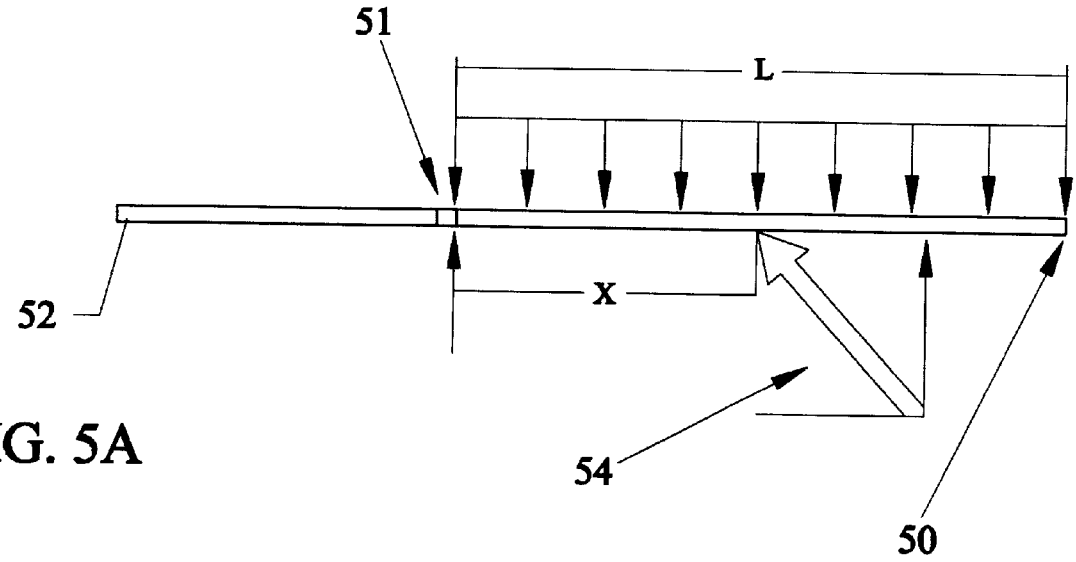
FIG. 5A shows the hinge location and position of pneumatic cylinder.

In FIG. 5 there are two drawings of the side view of the RoboTray. FIG. 5A illustrates the interaction of forces about the hinge (51) that controls the tilting mechanism which moves the work envelope (50) within an angular range of from approximately 90° to approximately 180° in relation to the horizontal stationary supporting base (52). The preferred angular position is approximately 135° as measured from the horizontal supporting base (52).

A pneumatic cylinder (54) is positioned on each side of the tray and is dimensioned to lift a uniform load of approximately 16.6 kilograms (30 lbs.). This load should be multiplied by two factors. One is for internal friction, an additional 25%, and the other for the cylinder's stroke speed, another 25%. Using data and formulae to determine an initial force on each cylinder, the total force applied to each cylinder is used to calculate a power factor which helps select the right bore diameter for the cylinder. A cylinder with the appropriate bore diameter is needed to provide a stable, reliable tilting mechanism that does not shift or falter during use.

Figure 5B:
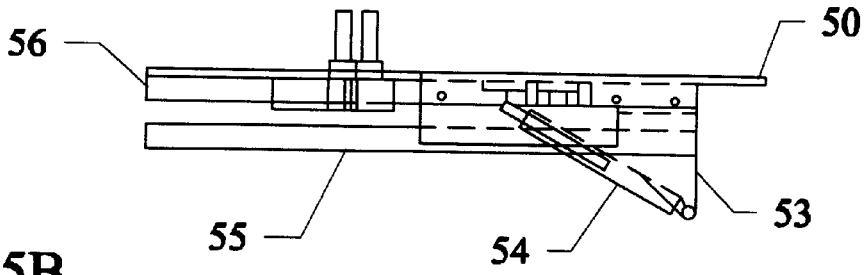
FIG. 5B shows locations for pneumatic pistons and controls for tilting, enlarging and reducing the size of the work envelope.

FIG. 5B shows greater detail of a side view. A mounting bracket for a pneumatic tube (53) is connected to the underside of the work envelope (50) holding a pneumatic cylinder (54) in position to activate the tilting mechanism. Supporting bars (55, 56) are attached to the underside of the work envelope to provide stability. The side view shown is replicated on the opposing side.

FIG. 6 has three illustrations of ergonomic controls, individually or collectively called "Ergo Aid(s)," that can be used to control the tilting, enlarging/reducing features of the RoboTray. 6A shows buttons (61, 62) that can be pressed if the user's manual dexterity is more suited to the up and down motion of pressing a button. 6B is the preferred embodiment of the controls for the RoboTray because it allows manipulation without having to accurately aim at a particular target, such as a button, to engage the control. The levers (63, 64) are sometimes called "joysticks" which operate like toggle switches and can be moved very slightly to effect movement or adjustment of the tray. The controls in 6C arc traditional foot pedals (65, 66) which may be connected to the pneumatic cylinders with hoses similar to the hose connections with buttons and levers. The connection from floor to cylinder may be made with flexible hoses that may be clipped to the chair in an inconspicuous manner. Foot pedal controls provide a reasonable alternative for tray adjustment if hand motor control or manual dexterity does not allow use of buttons or levers. Suitable buttons, levers or foot pedals for this invention are manufactured by Parker Hannifin Corporation, Pneumatic Division North America, Richland, Mich.

In the preferred embodiment, a first control extends the auxiliary supporting rack and the second control tilts the work envelope. In other words, each control has a separate function. However, it is possible for the controls to be located in different positions on the horizontal stationary supporting base as long as the control is not placed in a position that interferes with the work envelope. For example, both the first controlling means and second controlling means can be on one side of the horizontal stationary supporting base if that position accommodates the user's ability. As discussed above, foot controls could be used if it is easier for the user. The location of the controls can be designed for the convenience of the user.

FIG. 7 is a top view of the RoboTray. The horizontal stationary supporting base (70) is in a position that is 180° from the movable top portion (71). Lever controls (72, 73) are positioned on the top surface of the horizontal base (70) so that there is no interference with the movable top portion or work envelope (71). Tubular rods (74, 75) and used to connect the RoboTray to a conventional wheelchair mounted with a tubular sleeve to receive the rods. A raised edge or rail (76) closes the end of the auxiliary supporting rack. The raised edge (76) prevents objects from sliding off the edge of the rack and provides a stabilizing frame to received the ends of the rods that are the functional elements of the extendible rack.

FIG. 8 is a planar view of the RoboTray from the direction of a seated user. The end sections of the supporting frame (80, 82) are shown; the tray is mounted on the supporting frame (80, 82) in a traditional manner familiar to those skilled in the art. Metal supports are welded to a metal frame which are then bolted to the underside of the tray. The RoboTray surface can be manufactured with wood or plastic materials. It is preferable to have lightweight, heat and fire-resistant material that is easily washed and difficult to soil. In a preferred embodiment a polymeric plastic material, polycarbonate, is selected for the tray surface.

FIG. 9 shows the underside of the RoboTray and the location of the solenoid switches (90,91) at the base of each control lever. Brackets or rod guides (92, 93) are positioned to receive and support the rods of the extendable auxiliary supporting rack. A pneumatic cylinder (94) is positioned in the center of the auxiliary supporting rack and is mounted against a block (95) such that when the control (91) is activated, the pneumatic cylinder (94) can either push or retract the rack. Two additional pneumatic cylinders (96, 97) are mounted on brackets beneath the tray surface and when activated by the second controller (90) the movable top portion (71) can be tilted between the angular range of from approximately 180° to approximately 90° in relation to the horizontal stationary supporting base (70). The pneumatic cylinders used in the present invention are manufactured by Parker Pneumatic, Richland, Mich. The horizontal stationary supporting base (70) and movable top portion (71) are supported by chrome steel rods (98, 99) which are connected by a plastic living hinge (not shown) at the base (100) of the movable top portion. The hinge is shown in FIG. 5A; one embodiment of the present invention uses a chrome plated brass piano hinge.

FIG. 10 has diagrams of the compressed fluid supply to the pneumatic cylinders. The compressed fluid or gas supply to power the tray can be carbon dioxide ($CO_2$), nitrogen, or ambient air. Because the pressure required to store nitrogen, it is preferred to use carbon dioxide or air. The gas supply may be a compressed air cylinder which is refilled daily from a compressor. Or, a small air compressor could be mounted on the wheelchair and operated with batteries of the chair. The battery-operated, small air compressor would automatically refill a small pneumatic cylinder when the pressure drops from use.

In FIG. 10A , an air flow diagram for the tray table lift mechanism is shown. Compressed air enters a three position valve (101) flows through a needle valve (102) to activate two single acting spring return cylinders (103, 104) which work simultaneously to lift the movable top portion of the RoboTray. When lowering the movable top portion, an Ergo Aid is engaged to release air which returns through the needle valve (102) and exits through the exhaust (105). In FIG. 10B, an air flow diagram for the tray table extension is shown. Compressed air enters a two position valve (106) applying force to a single acting spring return cylinder (107) which extends the auxiliary supporting rack in an outward direction. When the Ergo Aid is engaged to retract the extendible rack, air flows through the needle valve (108) and out of the exhaust (109) as the rack retracts.

An optional feature of the invention would be the installation of a removable cover on the underside portion of the tray to protect the components from dust, damage or other exposure that could interfere with the mechanical operation.

While the invention has been described, disclosed, illustrated and shown in various terms of certain embodiments or modifications which it has presumed in practice, the scope of the invention is not intended to be, nor should it be deemed to be, limited thereby and such other modifications or embodiments as may be suggested by the teachings herein are particularly reserved especially as they fall within the breadth and scope of the claims here appended.

We claim:

1. An attachable and detachable tray assembly for a wheel chair which comprises:

(a) an adjustable tray table having its top member divided into a horizontal stationary supporting base and a movable top portion which can be tilted in various directions therefrom:

(b) an auxiliary supporting rack attached to the movable top portion and extendible to at least one side therefrom;

(c) means for holding the movable top portion in a tilted position;

(d) means for securing the horizontal stationary supporting base in a horizontal position on a wheel chair arm;

(e) a first controller means for adjustably extending said auxiliary supporting rack; and (f) a second controller means for adjustably tilting the movable top portion.

2. A tray assembly of claim 1, wherein the horizontal stationary supporting base is attached to the movable top portion with a hinge means.

3. A tray assembly of claim 1,wherein the horizontal stationary supporting base has a cutout edge to accommodate a torso of a seated user.

4. A tray assembly of claim 1, wherein the auxiliary supporting rack is extendible from a position selected from the group consisting of seated user's left hand side, seater user's right hand side, and both left and right sides of seated user.

5. A tray assembly of claim 4, wherein the auxiliary supporting rack has a raised edge.

6. A tray assembly of claim 1, wherein the means for holding the movable top portion in a tilted position is a fluid piston cylinder.

7. A tray assembly of claim 6, wherein the movable top portion is held securely in a tilted position within an angular range from approximately 90° to approximately 180° in relation to the horizontal stationary supporting base.

8. A tray assembly of claim 7, wherein the angular range is approximately 135°.

9. A tray assembly of claim 1, wherein said adjustable tray table top member is constructed of a light weight, heat and fire-resistant material.

10. A tray assembly of claim 1, wherein the means for securing the horizontal stationary supporting base to the wheel chair arm further comprises a means for telescopingly attaching a portion of the horizontal stationary supporting base to a portion on the wheel chair.

11. A tray assembly of claim 10, wherein the telescoping attachment means includes a sleeve sliding about a tube.

12. A tray assembly of claim 1, wherein the first controller means includes a solenoid switch.

13. A tray assembly of claim 12, wherein the first controller means is a button.

14. A tray assembly of claim 12, wherein the first controller means is a lever.

15. A tray assembly of claim 12, wherein the first controller means is a pedal.

16. A tray assembly of claim 1, wherein the second controller means includes a solenoid switch.

17. A tray assembly of claim 16, wherein the second controller means is a button.

18. A tray assembly of claim 16, wherein the second controller means is a lever.

19. A tray assembly of claim 16, wherein the second controller means is a pedal.

20. A tray assembly of claims 13, 14, 17 or 18, wherein at least one of the first controller means and the second controller means is located on an upper surface of the horizontal stationary supporting base of the tray adjacent a seated user.

* * * * *